US005361856A

United States Patent [19]

Surjaatmadja et al.

[11] Patent Number: 5,361,856

[45] Date of Patent: Nov. 8, 1994

[54] WELL JETTING APPARATUS AND MET OF MODIFYING A WELL THEREWITH

[75] Inventors: Jim B. Surjaatmadja, Duncan; Steven L. Holden, Fletcher; David D. Szarka, Duncan, all of Okla.

[73] Assignee: Halliburton Company, Duncan, Okla.

[21] Appl. No.: 119,370

[22] Filed: Sep. 9, 1993

Related U.S. Application Data

[63] Continuation-in-part of Ser. No. 953,671, Sep. 29, 1992, Pat. No. 5,249,628.

[51] Int. Cl.[5] ..... E21B 7/18

[52] U.S. Cl. ..... 175/67; 166/308

[58] Field of Search ..... 175/67–72, 175/339, 340, 429–431; 166/298, 308

[56] References Cited

U.S. PATENT DOCUMENTS

| | | | |
|---|---|---|---|
| 4,673,312 | 6/1987 | Nussbaumer | 175/67 X |
| 4,768,709 | 9/1988 | Yie | 175/67 X |
| 4,787,465 | 11/1988 | Dickinson, III et al. | 175/67 |
| 4,818,197 | 4/1989 | Mueller | 418/48 |
| 4,850,431 | 7/1989 | Austin et al. | 166/308 |
| 4,930,586 | 6/1990 | Turin et al. | 175/67 X |
| 4,949,788 | 8/1990 | Szarka et al. | 166/285 |
| 4,979,561 | 12/1990 | Szarka | 166/240 |
| 4,991,653 | 2/1991 | Schwegman | 166/312 |
| 4,991,654 | 2/1991 | Brandell et al. | 166/332 |
| 4,991,667 | 2/1991 | Wilkes, Jr. et al. | 175/67 X |
| 5,029,644 | 7/1991 | Szarka et al. | 166/223 |
| 5,097,902 | 3/1992 | Clark | 166/187 |
| 5,133,410 | 7/1992 | Gadelle et al. | 166/308 |

OTHER PUBLICATIONS

Halliburton Services Sales & Service Catalog No. 43, p. 2575 (1985).

Information from Roper Pumps (undated but admitted to be prior art).

*Primary Examiner*—Michael Powell Buiz

*Attorney, Agent, or Firm*—Stephen R. Christian; Neal R. Kennedy

[57] ABSTRACT

A well jetting apparatus for use in fracturing of a well. Fracture initiation is provided by forming openings through the well casing and then forming fan-shaped slots in the formation surrounding the casing. Those slots are formed by a the jetting apparatus which has at least one hydraulic jet directed through the opening. The apparatus may be pivoted generally about the point of the opening to form the slots, but preferrably a plurality of slots are formed substantially simultaneously. These fan-shaped slots circumscribe an angle about the axis of the casing substantially greater than the angle circumscribed by the opening itself through which the slot was formed. These techniques are particularly applicable to fracturing of horizontal wells, but the apparatus may be used in any well configuration.

10 Claims, 11 Drawing Sheets

WELL JETTING APPARATUS AND MET OF MODIFYING A WELL THEREWITH

This is a continuation in part of co-pending application Ser. No. 07/953,671, filed Sep. 29, 1992 now U.S. Pat. No. 5,249,628.

BACKGROUND OF THE INVENTION

1. Field of the Invention

The present invention relates generally to the completion of oil and gas wells through fracturing operations, and more particularly, but not by way of limitation, to a jetting apparatus for cutting fan-shaped slots in a plane substantially perpendicular to a longitudinal axis of the well. The apparatus is will adapted for use on horizontal wells, but is not intended to be so limited.

2. Description of the Prior Art

Several different techniques are currently used for the completion of horizontal wells.

A first, very common manner of completing a horizontal well is to case and cement the vertical portion of the well and to leave the horizontal portion of the well which runs through the producing formation as an open hole, i.e., that is without any casing in place therein. Hydrocarbon fluids in the formation are produced into the open hole and then through the casing in the vertical portion of the well.

A second technique which is commonly used for the completion of horizontal wells is to place a length of slotted casing in the horizontal portion of the well. The purpose of the slotted casing is to prevent the open hole from collapsing. A gravel pack may be placed around the slotted casing. The slotted casing may run for extended lengths through the formation, for example as long as one mile.

A third technique which is sometimes used to complete horizontal wells is to cement casing in both the vertical and horizontal portions of the well and then to provide communication between the horizontal portion of the casing and the producing formation by means of perforations or casing valves. The formation may also be fractured by creating fractures initiating at the location of the perforations or the casing valves.

In this third technique, the formation of perforations is often done through use of explosive charges which are carried by a perforating gun. The explosive charges create holes which penetrate the side wall of the casing and penetrate the cement surrounding the casing. Typically, the holes will be in a pattern extending over a substantial length of the casing.

When the communication between the casing and the producing formation is provided by casing valves, those valves may be like those seen in U.S. Pat. No. 4,949,788 to Szarka et al., U.S. Pat. No. 4,979,561 to Szarka, U.S. Pat. No. 4,991,653 to Schwegman, U.S. Pat. No. 5,029,644 to Szarka et al., and U.S. Pat. No. 4,991,654 to Brandell et al., all assigned to the assignee of the present invention. Such casing valves also provide a large number of radial bore type openings communicating the casing bore with the surrounding formation.

When utilizing either perforated casing or casing valves like those just described, the fracturing fluid enters the formation through a large multitude of small radial bores at a variety of longitudinal positions along the casing and there is no accurate control over where the fracture will initiate and in what direction the fracture will initiate.

In the context of substantially deviated or horizontal wells, the cementing of casing into the horizontal portion of the well followed by subsequent fracture treatments has not been as successful as desired when using existing techniques, especially when multiple zone fracturing is involved.

The present invention solves these problems by providing a jetting apparatus which cuts the slots in the formation in a plane substantially perpendicular to the longitudinal axis of the well casing. In a preferred embodiment, a plurality of such slots are cut substantially simultaneously, and the apparatus insures that the slots are coplanar. This allows initiation of the fracture such that the fracture moves outwardly away from the wellbore so that the direction of the fracture will not be controlled by the local stresses immediately surrounding the casing and wellbore which might otherwise cause the fracture to follow the wellbore.

SUMMARY OF THE INVENTION

It has been determined that one of the reasons fracturing of horizontal wells has not been completely satisfactory in the past is that when a fracture radiates outward in a plane transverse to and preferably perpendicular to the longitudinal axis of the casing, the subsurface formation tends to move on either side of the fracture in a direction generally parallel to the longitudinal axis of the casing, but the casing itself cannot move. Thus, the relative movement between the subsurface formation and the casing often causes a destruction of the bond between the casing and the surrounding cement. This destruction of the cement/casing bond may extend for large distances thus providing a path of communication between adjacent subsurface formations which are to be fractured.

An improved fracturing technique has been developed which eliminates this problem. This is accomplished by providing casing slip joints adjacent the location where the fracture is to be initiated. Preferably, such casing slip joints are provided on both sides of the fracture initiation location. The casing slip joints allow the casing to move with the expanding formation when fracturing occurs. This aids in preventing a destruction of the bond between the cement and the casing. Preferably, the use of casing slip joints is accompanied by the provision of a means for directing the initial direction of fracture initiation so that the fracture initiates in a plane generally perpendicular to the longitudinal axis of the casing.

It has been determined that another reason fracturing of horizontal wells has not been completely satisfactory in the past is that the stresses which are created within the formation immediately surrounding the casing and cement in a horizontal well are such that quite often the fracture will not radiate outward in a plane perpendicular to the axis of the well as is most desirable, but instead quite often the fracture will run parallel to the casing and thus will allow communication between adjacent formations.

An improved method and apparatus have been developed for initially communicating the casing bore with the surrounding formation so as to provide a predetermined point of initiation of the fracture and so as to provide directional guidance to the fracture when it is initiated.

This is accomplished by inserting one of the embodiments of the hydraulic jetting tool of the present invention into the casing. One or more openings are formed through the casing, and preferably those openings are formed by the hydraulic jetting tool itself.

The hydraulic jetting tool is then used to direct one or more hydraulic jets through the opening in the casing to cut one or more fan-shaped slots in the surrounding formation in a plane transverse to the longitudinal axis of the casing. In a preferred embodiment, a plurality of such slots are cut substantially simultaneously and are coplanar. Each of these fan-shaped slots circumscribes a substantially larger arc about the axis of the casing than does the opening through which the slot was cut.

Preferably these fan-shaped slots lie in a plane substantially perpendicular to the longitudinal axis of the casing.

Subsequently, when fracturing fluid is applied under pressure to the fan-shaped slots, the fracture will initiate in the plane of the fan-shaped slots and will at least initially radiate outward from the well bore along that plane. This will occur regardless of the orientation of the natural least principal stress axis within the surrounding formation.

The provision of the fan-shaped slots will allow initiation of the fracture and allow it to move outward away from the wellbore sufficiently so that the direction of the fracture will not be controlled by the local stresses immediately surrounding the casing and wellbore which might otherwise cause the fracture to follow the wellbore.

Numerous objects, features and advantages of the present invention will readily apparent to those skilled in the art upon a reading of the following disclosure when taken in conjunction with the accompanying drawings.

Figure 8A:
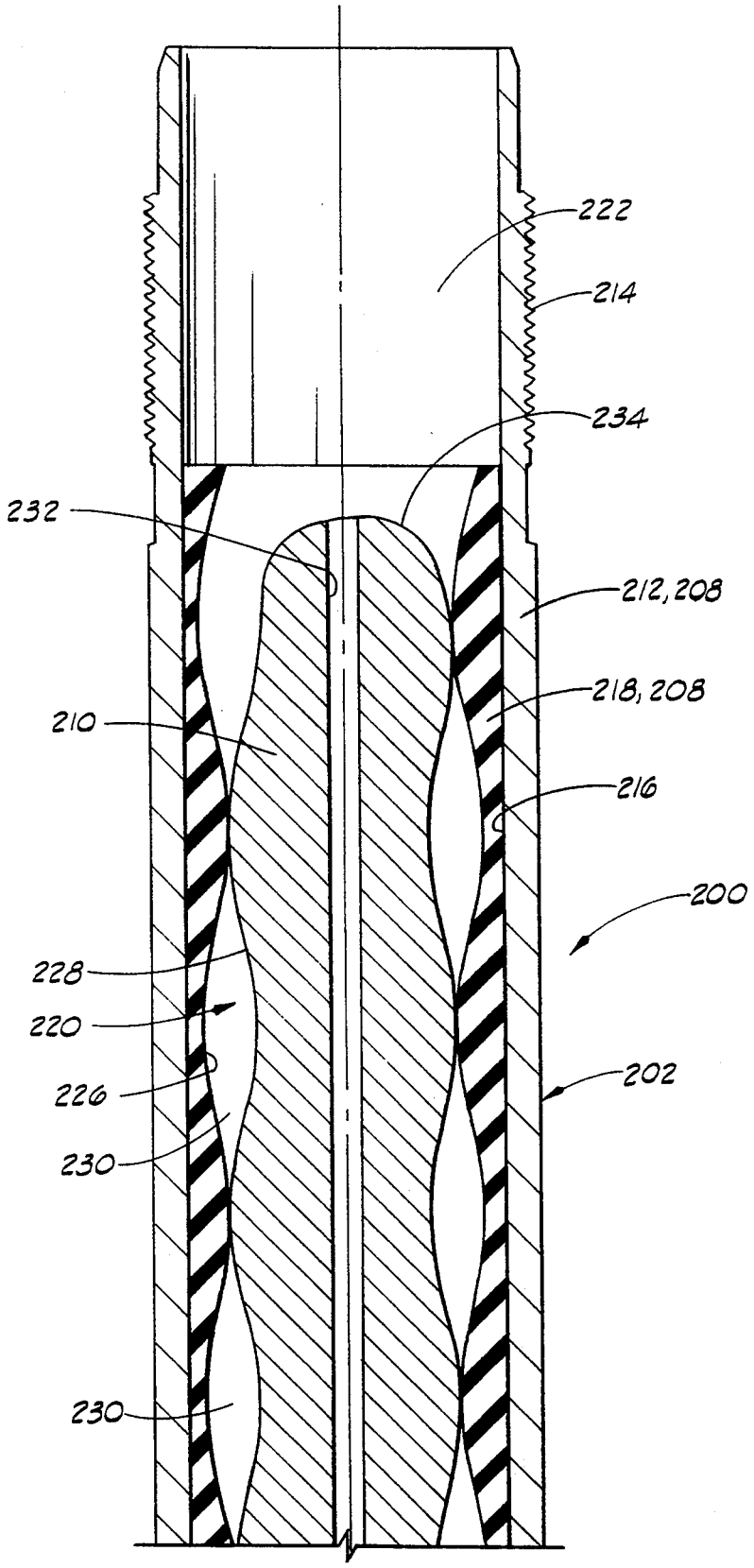
FIGS. 8A–8D illustrate a preferred embodiment of the hydraulic well jetting apparatus which may be used for cutting a plurality of slots substantially simultaneously.
Figure 8B:
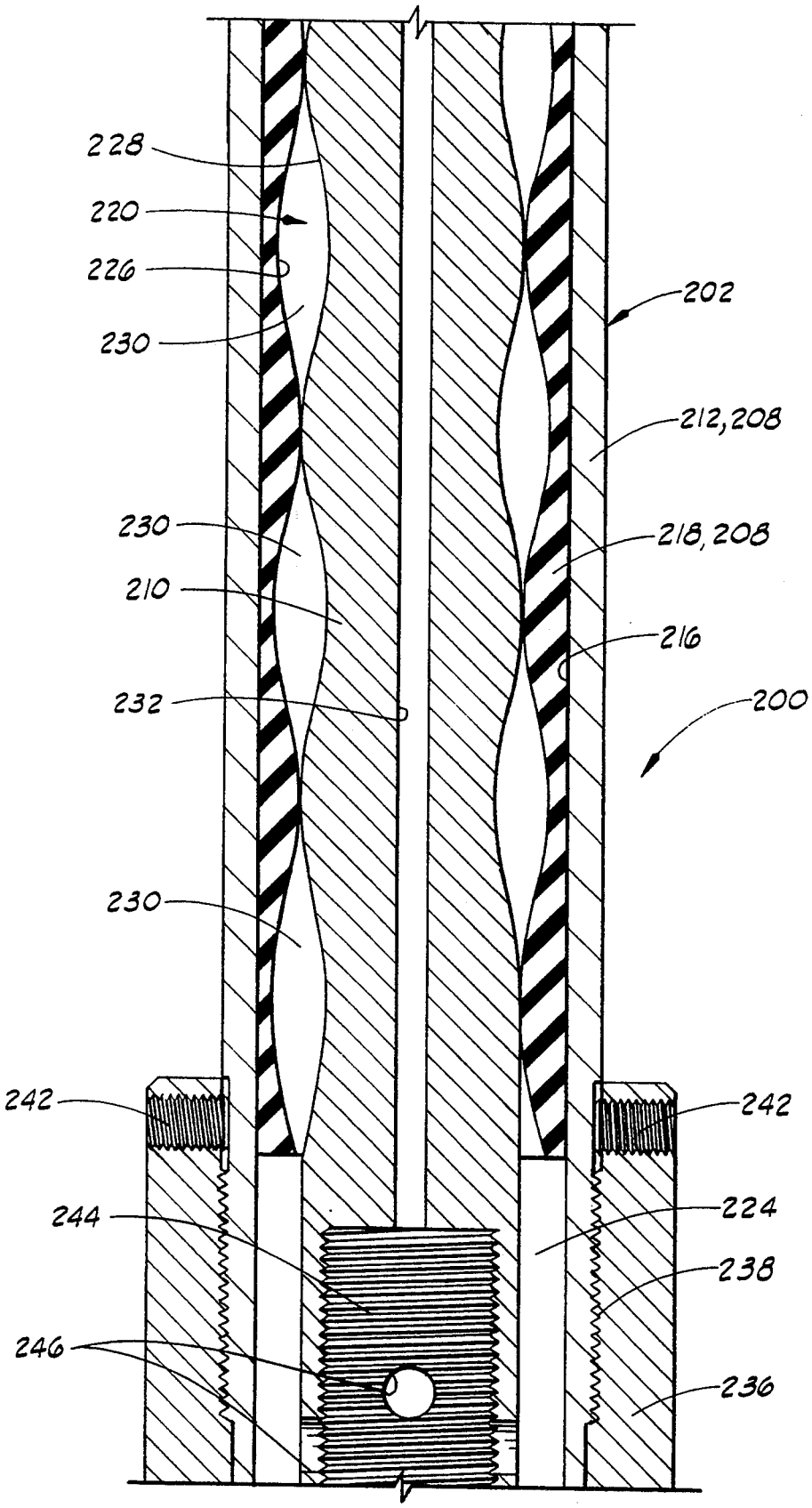
Figure 8C:
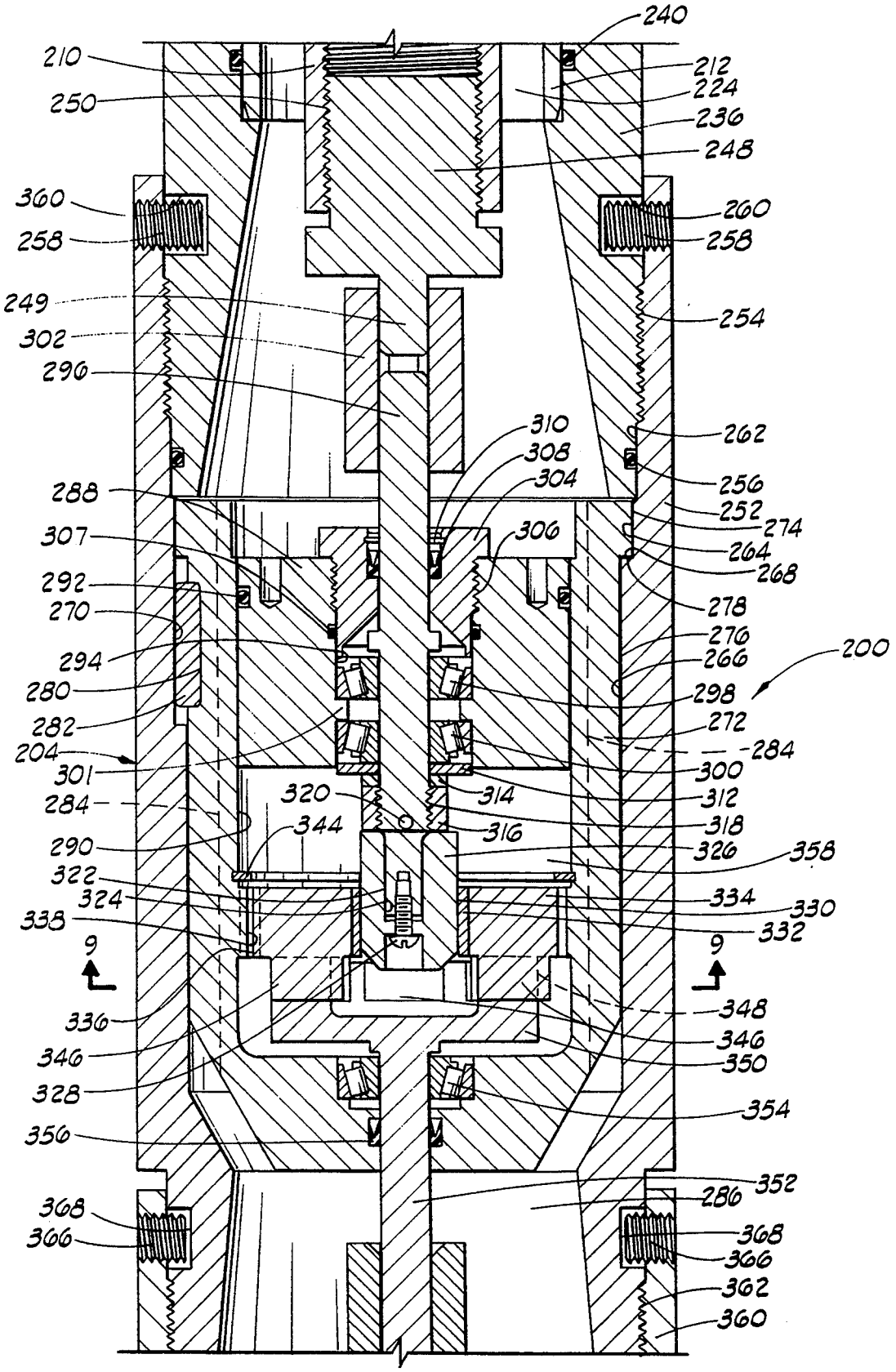

FIG, 9 shows a cross section taken along lines 9—9 in FIG. 8C.

Figure 8D:
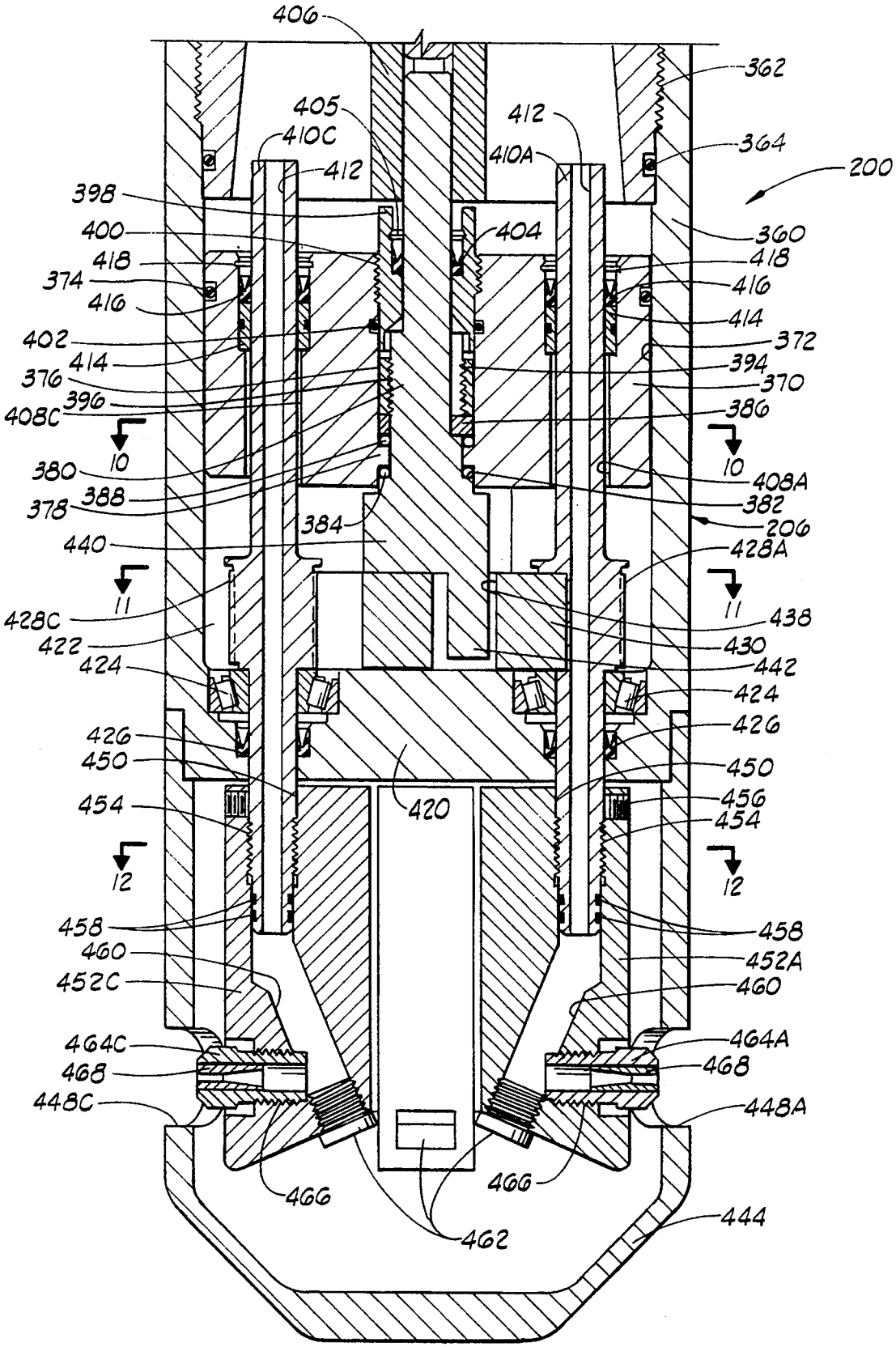
Figure 10:
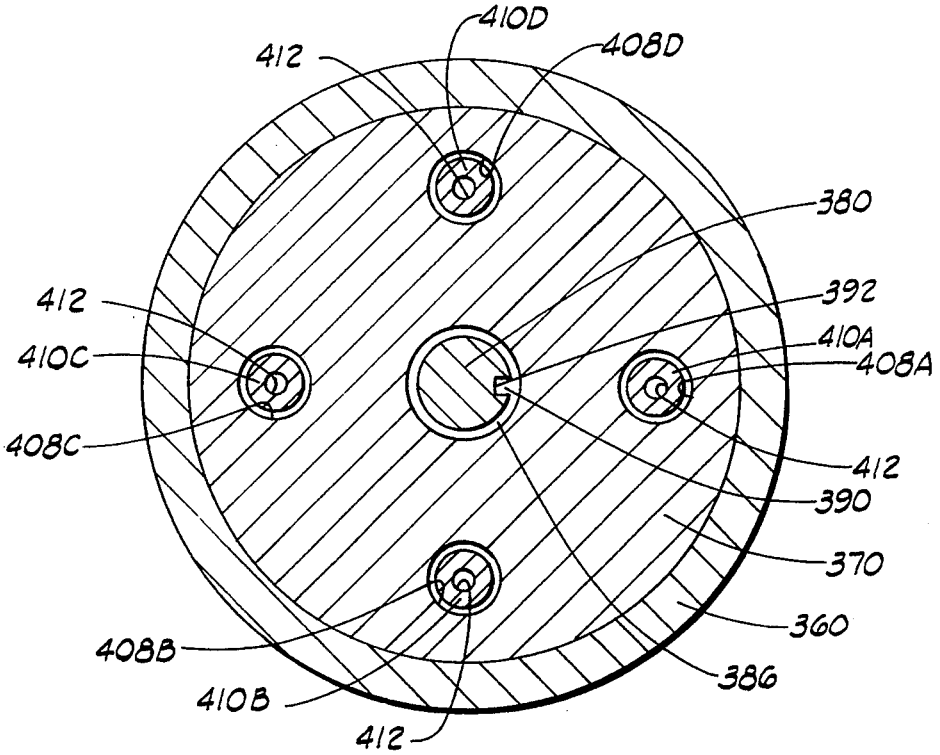

FIG. 10 is a cross section taken along lines 10—10 in FIG. 8D.

Figure 11:
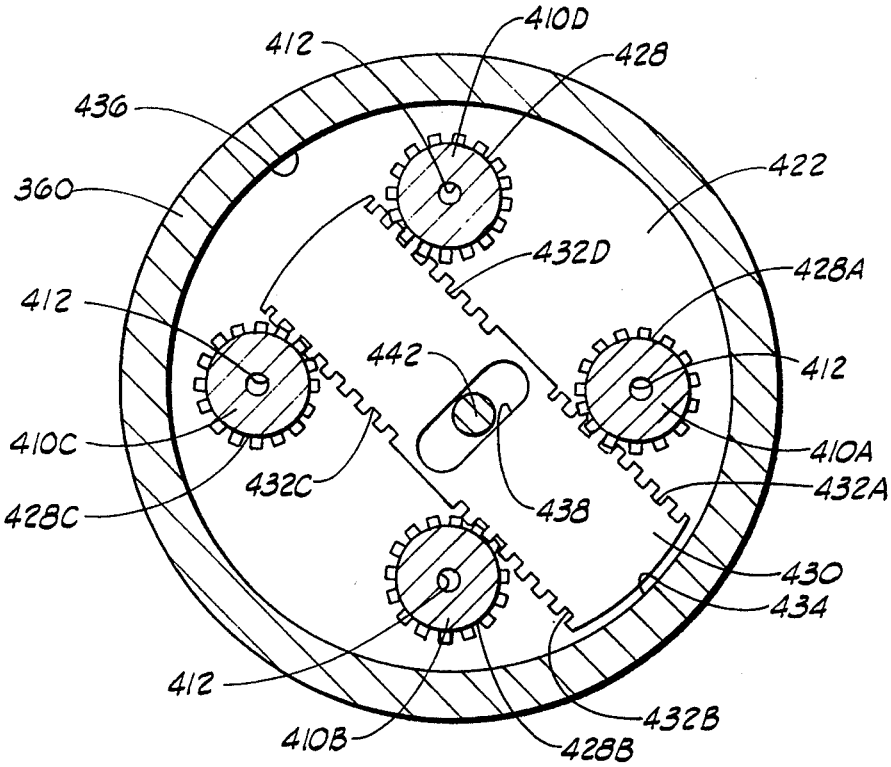

FIG. 11 illustrates a cross section taken along lines 11—11 in FIG. 8D.

Figure 12:
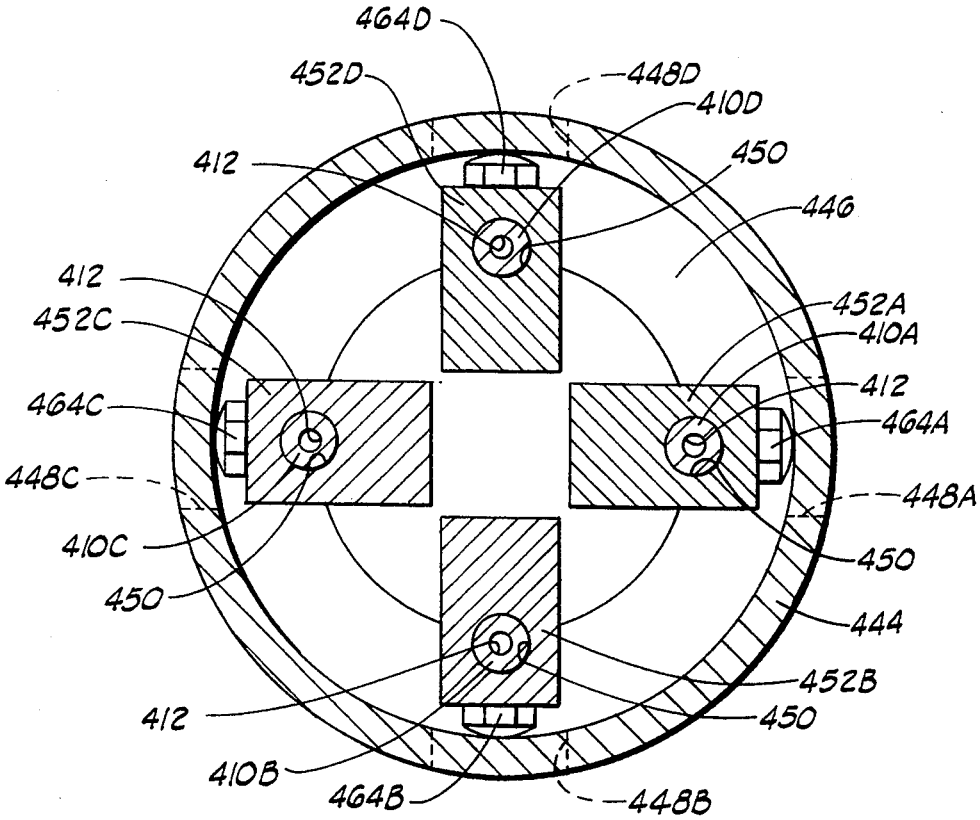

FIG. 12 is a cross-sectional view taken along lines 12—12 in FIG. 8D.

Figure 1:
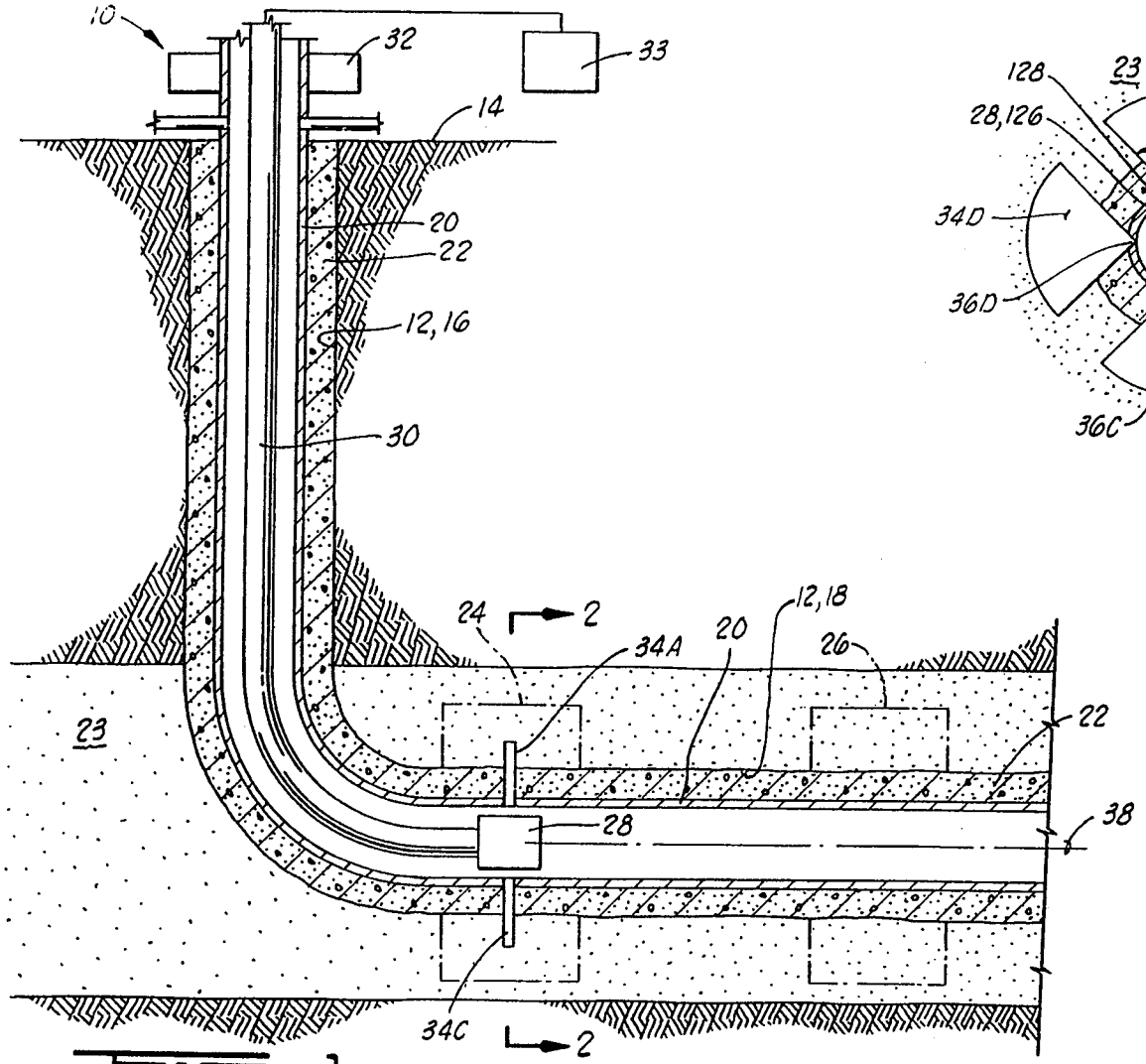
FIG. 1 is an elevation schematic sectioned view of a well having a horizontal portion which has been cased and cemented. The formation is shown as having had radially extending fan-shaped slots cut therein.
Figure 13:
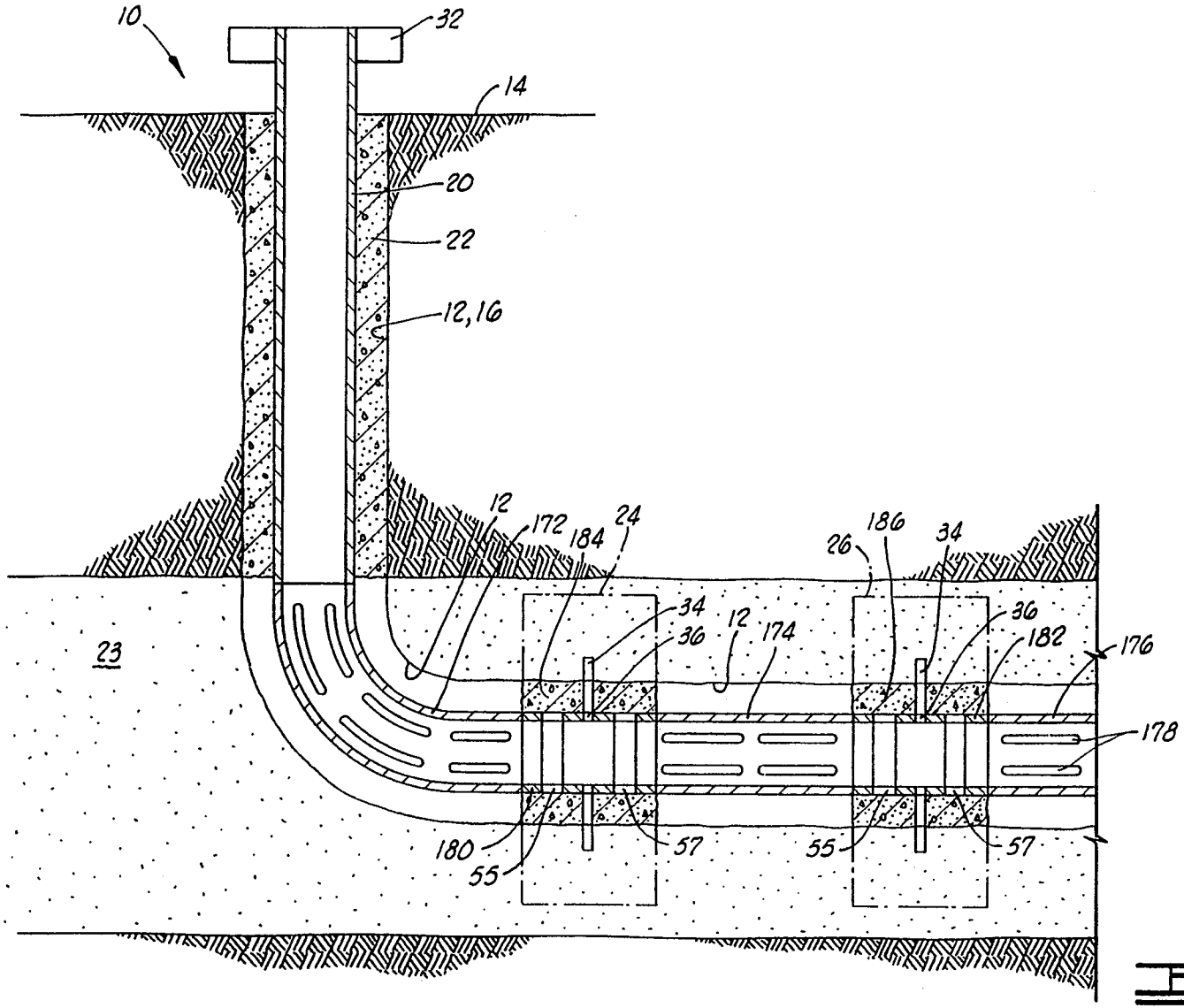

FIG. 13 is a view similar to FIG. 1 illustrating the use of the invention in combination with slotted casing in an open borehole in parts of the horizontal portion of the well.

DETAILED DESCRIPTION OF THE PREFERRED EMBODIMENTS

Referring now to the drawings, and particularly to FIG. 1, a well is shown and generally designated by the numeral 10. The well is formed by a wellbore 12 which extends downward from the earth's surface 14. The wellbore 12 has an initial, generally vertical portion 16 and a lower, generally horizontal portion 18.

The well 10 includes a casing string 20 which is located within the wellbore 12 and cemented in place therein by cement 22.

The horizontal portion 18 of wellbore 12 is shown as intersecting a subterranean formation 23 in which are located two imaginary zones which are to be fractured. The zones are outlined in phantom lines and are generally designated by the numerals 24 and 26.

A hydraulic jetting tool schematically illustrated and designated by the numeral 28 has been lowered into the casing 20 on a tubing string 30. A conventional wellhead 32 is located at the upper end of the well at the earth's surface.

A source of high pressure fluid 33 is connected to the tubing string 30 to provide hydraulic fluid under high pressure to the hydraulic jetting tool 28.

In the first zone 24, two fan-shaped slots 34A and 34C are shown in cross section extending through the cement 22 into the surrounding zone 24. The slots have been cut by the hydraulic jetting tool 28 in a manner further described below.

Figure 2:
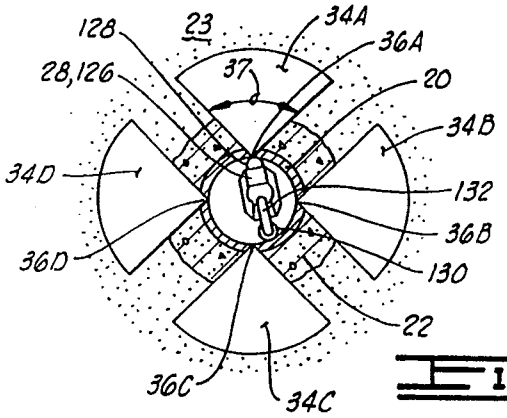
FIG. 2 is a schematic view taken along line 2—2 of FIG. 1 in a plane perpendicular to the longitudinal axis of the wellbore showing an embodiment of the hydraulic well jetting apparatus of the present invention used for cutting fan-shaped slots one at a time which surround the casing.

FIG. 2 is a cross-sectional view taken along line 2—2 of FIG. 1 and showing a preferred pattern of fan-shaped slots including four fan-shaped slots 34A, 34B, 34C and 34D. The number and pattern of slots may vary.

As seen in FIG. 2, there is associated with each of the fan-shaped slots 34A, 34B, 34C and 34D an opening 36 formed through the casing 20. These openings are designated by the numerals 36A, 36B, 36C and 36D, respectively.

The fan-shaped slots 34 are shown as lying in a plane substantially perpendicular to a longitudinal axis 38 of the horizontal portion of the casing 20.

In FIG. 2, the hydraulic jetting tool 28 is shown in position for formation of the opening 36A and radial fan-shaped slot 34A.

Preferably, the opening 36A is formed through the casing 20 by the hydraulic jetting action of jetting tool 28. Then, using the opening 36A as a base or pivot point, the hydraulic jetting tool 28 is rotated back and forth through an arc corresponding to an angle 37 formed by the fan-shaped slot about the point of the opening 36A so that the hydraulic jet which shoots through the opening 36A will cut the fan-shaped slot 34A.

As is apparent in FIG. 2, the fan-shaped slot 34A circumscribes a substantially larger arc about the axis 38 of casing 20 than does the small opening 36A through which the fan-shaped slot 34A was cut.

In its broadest terms, the fan-shaped slot concept does not require that the pivotal base of the slot 34 be located at the opening 36. It is required, however, that the slots be formed in a manner such that the structural integrity of the casing is maintained.

Although it is preferred to form the openings 36 by the hydraulic jetting action just described, it is also within the scope of the present invention to use preformed holes, such as those which would be provided by a casing valve like that shown in Brandell et al., U.S. Pat. No. 4,991,654, in which case the jetting tool 28 would be located adjacent an existing hole provided in the casing valve and the fan-shaped slots would be cut through the existing holes of the casing valve.

It is also within the scope of the present invention to cut the fan-shaped slots 34 in planes other than planes perpendicular to the longitudinal axis 38. Also, the fan-shaped slots may be cut in a vertical portion rather than a horizontal portion of the well.

Furthermore, it is possible to cut the fan-shaped slots 34 to modify the well 10 for reasons other than fracturing the well. For example, the fan-shaped slots 34 may be utilized as a substitute for perforations communicating the casing bore with the surrounding formation.

By forming the fan-shaped slots 34 as shown in FIG. 2 wherein each slot 34 circumscribes a substantially larger arc about the longitudinal axis 38 than does the opening 36 through which the slot is formed, the integrity of the casing, i.e., the structural strength of the casing, is maintained.

Figure 3:
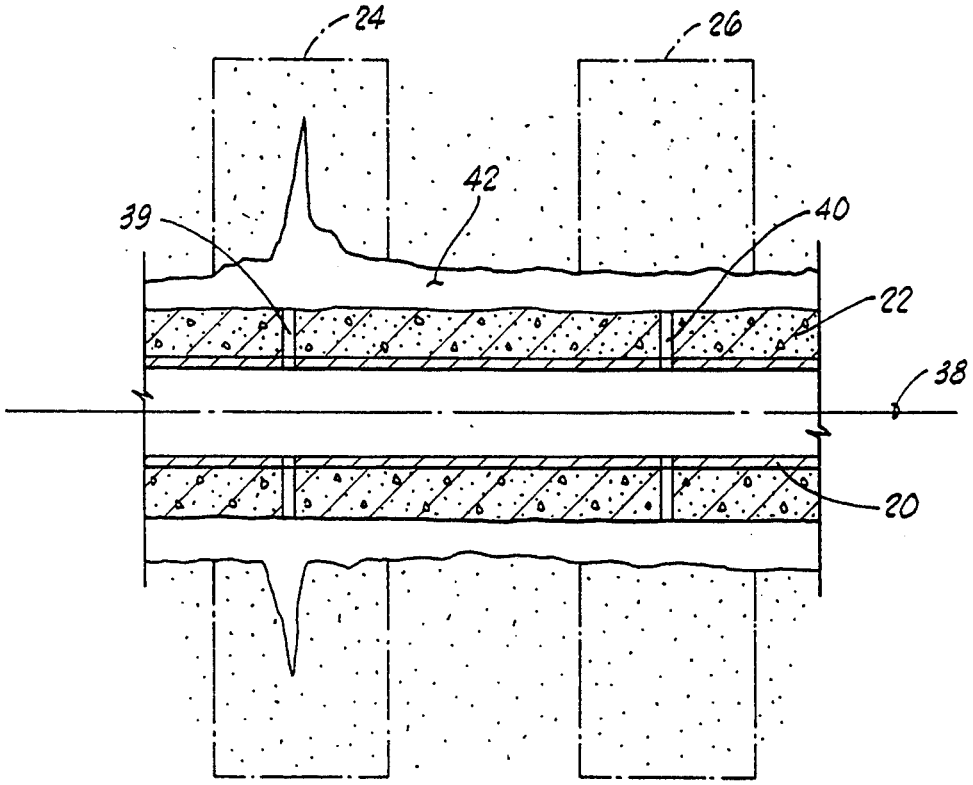
FIG. 3 (PRIOR ART)
FIG. 3 is a schematic illustration of the problem present in the prior art when multiple zones of a horizontal well are fractured, with the fracture propagating parallel to the wellbore so that the zones communicate with each other.

FIG. 3 illustrates a problem which occurs with prior art fracturing techniques for horizontal wells. It will be appreciated that FIG. 3 is a very schematic illustration. FIG. 3 generally shows the well casing 20 cemented in place within the wellbore 12 by cement 22.

Two subsurface zones to be fractured, such as zones 24 and 26 are illustrated. The location of openings such as perforations, casing valves or the like at locations adjacent zones 24 and 26 are schematically illustrated by the openings 39 and 40, respectively. The openings 39 and 40 are only schematically representative of some type of communication between the casing bore and the zones 24 and 26, respectively, which is present prior to the fracturing of the well.

I have determined that one problem which often occurs when fracturing horizontal wells is that, when the fracture is initiated, the fracture will propagate generally parallel to the longitudinal axis 38 of the casing 20. This occurs due to the local stresses immediately surrounding the casing 20 and cement 22, and often it occurs around the cement/formation bond, and thus will create a fracture space generally designated at 42 which generally follows the wellbore and may in fact provide communication between the two subsurface zones 24 and 26. Thus even if individual fracturing jobs are performed on the two zones 24 and 26, if a path of communication is formed between those zones, it may be that one or both of the zones will not be satisfactorily fractured, and of course individual production from the zones will not be possible. When the second zone is being fractured, as soon as the fracture space 42 communicates with another previously opened or fractured area, typically fracture growth will cease because the surface pump supplying the fracturing fluid will typically not have sufficient fluid flow to maintain fracturing pressures once the fracture is opened to a large, previously opened zone.

Figure 4:
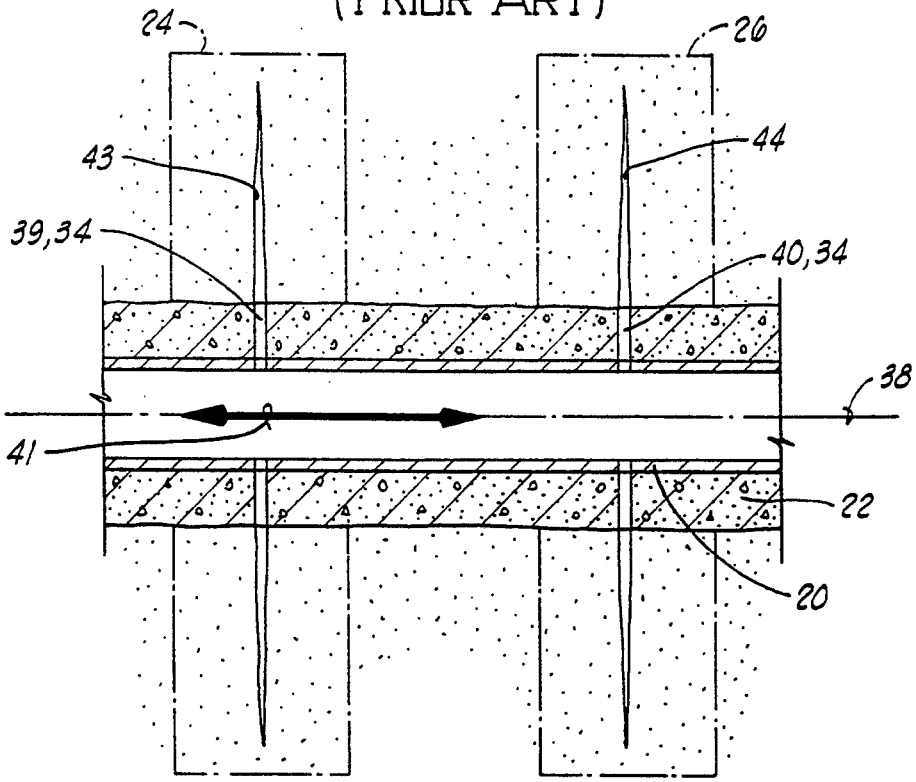
FIG. 4 is a schematic illustration of the manner in which fractures will propagate from the well utilizing the fan-shaped slots of the present invention when the least principal stress of the surrounding formation lies generally parallel to the longitudinal axis of the wellbore.
Figure 5:
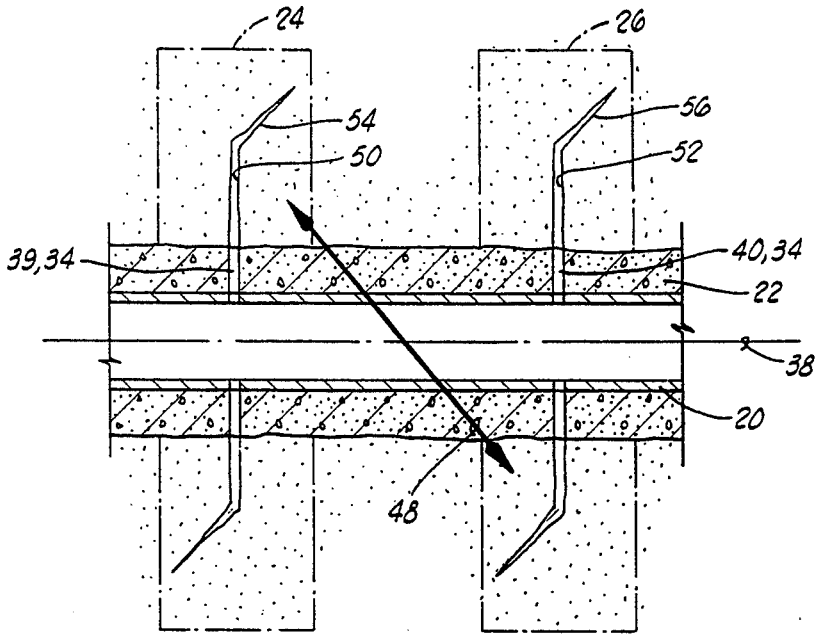
FIG. 5 is a view similar to FIG. 4 showing the manner in which fractures will propagate from the well utilizing the fan-shaped slots of the present invention when the least principal stress of the surrounding formation lies at an angle substantially transverse to the longitudinal axis of the wellbore, The fractures initially propagate outward in a plane perpendicular to the wellbore and then turn in a direction perpendicular to the least principal stress in the surrounding formation.

This problem is avoided by the use of the fan-shaped slots previously described as is schematically illustrated in FIGS. 4 and 5.

FIG. 4 schematically illustrates the situation which will occur when utilizing the methods of the present invention, when the least principal stress axis 41 naturally present in the surrounding formations lies generally parallel to the longitudinal axis 38 of the casing 20. If the openings generally represented at 39 and 40 are formed utilizing the fan-shaped slots illustrated in FIGS. 1 and 2, then the resulting fractures 43 and 44, respectively, will initiate in the plane of the fan-shaped slots 34 and will continue to radiate radially outward in generally that same plane as illustrated in FIG. 4. There will be no intercommunication between the zones 24 and 26 and each zone will be fractured in the desired manner.

FIG. 5 similarly illustrates what will happen when the least principal stress axis 48 is transverse to the longitudinal axis 38.

Again, the fractures will initiate and initially propagate outward in radial planes as indicated at 50 and 52, and will then turn in a direction generally perpendicular to the least principal stress axis 48 as indicated at 54 and 56, respectively.

Thus, in both of the cases shown in FIGS. 4 and 5, the fracture will initiate in the plane defined by the fan-shaped slots and will initially propagate a sufficient distance outward away from the casing 20 so that the local stresses around the casing 20 will not determine the ultimate direction of propagation of the fracture. The ultimate direction of propagation of the fracture will be determined by the least principal stress axis 41 or 48 present in the surrounding formation.

The fan-shaped slots 34 can be described as creating a localized least principal stress axis or direction in the formation substantially parallel to the longitudinal axis 38 thereby aiding subsequent fracture initiation in a plane generally perpendicular to the longitudinal axis 38.

The well 10 has been described herein as a substantially deviated well or horizontal well. It will be appreciated that the well need not be exactly horizontal to benefit from the present invention. Furthermore, even some substantially vertical wells may in some cases benefit from the use of the present invention. As used herein, the term highly deviated or substantially deviated well generally refers to a well the axis of which is deviated greater than 45° from a vertical direction.

THE USE OF CASING SLIP JOINTS IN FIG. 6

Figure 6:
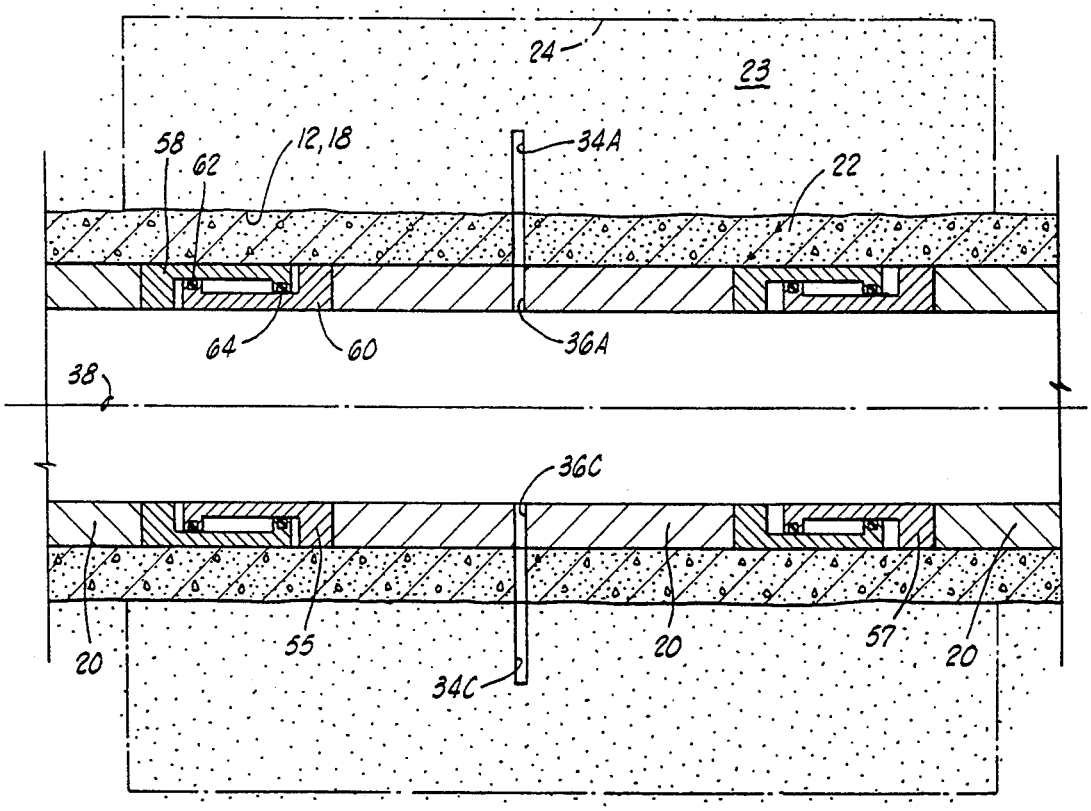
FIG. 6 is a schematic sectioned view of a portion of a horizontal well having casing slip joints located in the casing on opposite sides of the location of the fan-shaped slots.

FIG. 6 illustrates another aspect of the present invention, which improves the success of fracturing operations on horizontal wells by the use of casing slip joints.

The preferred orientation of fractures radiating outward from a horizontal well are generally like those described above with regard to FIGS. 4 and 5. One additional problem that occurs, however, particularly in connection with horizontal wells, is that when the fracture radiates outward in a plane perpendicular to the axis 38 of the well, this causes the surrounding rock formation to move in a direction parallel to the axis 38 of the well. Referring for example to the fracture 43 seen in FIG. 4, that portion of the formation to the right of the fracture 43 would move to the right, and that portion of the formation to the left of fracture 43 would move to the left relatively speaking. The casing 20, however, can not move in either direction, and it cannot stretch sufficiently to accommodate the movement of the surrounding formation. Thus, the movement of the surrounding formation relative to the casing may cause the bond between the cement 22 and the casing 20 to break down. This is particularly a problem when the fracturing of multiple subsurface zones is involved, since this breakdown of the cement-to-casing bond will allow a path of communication between multiple zones which were intended to be isolated from each other by the cement.

The formation and cement will attempt to move relative to the casing 20. Since the cement generally has low shear strength of about 300 psi and a modulus of elasticity of about 1,000,000 psi, it can be predicted that the bond between the cement and casing will fail. The length of such a failure can be predicted by the following formula:

$$L=FW\times E/S$$

Where FW is the maximum fracture width during pumping, E is the modulus of elasticity, and S is the shear strength of the cement bond. In a typical situation, the destruction length, that is, the length over which the casing/cement bond is destroyed, can exceed 800 feet. This can become a major cause of zone communication and will make fracturing treatments of closely spaced zones less effective. I have determined, therefore, that it is important to provide a means whereby this breakdown of the cement/casing bond will not occur.

In FIG. 6, first and second casing slip joints 55 and 57 are provided on opposite sides of the fan-shaped slots 34. Then, when fracturing fluid is pumped into the fan-shaped slots 34 to create and propagate a fracture like fracture 43 seen in FIG. 4, the slip joints 55 and 57 will allow movement of the casing 20 on opposite sides of the fracture along with the surrounding formation thus preventing the destruction of the bond between the casing 20 and cement 22 surrounding the casing during the fracturing operation.

The casing slip joints 55 and 57 are schematically illustrated in FIG. 6. Each will include two telescoping portions such as 58 and 60, preferably including sliding seals such as 62 and 64.

When the casing 20 is placed in the wellbore 12 and prior to placement of the cement 22 around the casing 20, steps should be taken to insure that the slip joints 55 and 57 are in a substantially collapsed position as shown in FIG. 6 so that there will be sufficient travel in the joints to allow the necessary movement of the casing. This can be accomplished by setting down weight on the casing 20 after it has been placed in the wellbore and before the cement 22 is placed or at least before the cement 22 has opportunity to set up.

Although two slip joints 55 and 57 are shown in FIG. 6 on opposite longitudinal sides of the openings 36, it will be appreciated that in many instances, a single slip joint will suffice to allow the necessary movement of the casing. It is preferred, however, to provide casing slip joints on both sides of the openings 36 to insure that any debonding of the cement 22 and casing 20 which may initiate adjacent the openings 36 will terminate when it reaches either of the slip joints 55 and 57 and will not propagate beyond the slip joints. This prevents any destruction of the cement/casing bond on a side of the slip joints longitudinally opposite the openings 36.

The formation of the fan-shaped slots 34 can be generally described as forming a cavity 34 in the formation 23 and thereby creating in the subsurface formation 23 adjacent the cavity 34 a localized least principal stress direction substantially parallel to the longitudinal axis 38 of the casing 20. Thus, the fracture such as 43 (see FIG. 4) will initiate in a plane generally perpendicular to the longitudinal axis 38.

It will be appreciated that the aspect of the present invention utilizing the casing slip joints may be used without the use of the fan-shaped slots described in FIGS. 1 and 2. The use of the fan-shaped slots is the preferred manner of initiating fractures in combination with the casing slip joints. Other means may be used, however, for initiating the fracture in the preferred direction, that is, in a plane radiating outward generally perpendicular to the longitudinal axis 38.

Figure 2A:
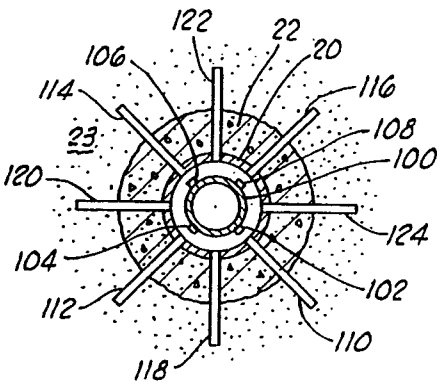
FIG. 2A is a view similar to FIG. 2, showing a pattern of eight radially extending bores located in a common plane perpendicular to the axis of the wellbore.

For example, FIG. 2A is a view similar to FIG. 2 which illustrates an alternative method of initiating the fracture in the preferred direction.

In FIG. 2A, a hydraulic jetting tool 100 has four jets 102, 104, 106 and 108 which are located in a common plane and spaced at 90° about the longitudinal axis of the tool 100. The jetting tool 100 may be located within the casing 20 and used to jet a first set of four radial bores or cavities 110, 112, 114 and 116. If more cavities are desired, the jetting tool 100 can then be rotated 45° to jet a second set of four radial bores 118, 120, 122 and 124.

Then when hydraulic fracturing fluid is applied under pressure to the radial bores 110–124, a fracture will tend to initiate generally in the plane containing the radial bores 110–124.

APPARATUS FOR FORMING FAN-SHAPED SLOTS

EMBODIMENT OF FIG. 2

In FIG. 2, one form of apparatus 28 for forming the fan-shaped slots 34 is schematically illustrated. The apparatus 28 includes a housing 126 having a jet nozzle 128 on one side thereof. A positioning wheel 130 is carried by a telescoping member 132 which extends when the telescoping member 132 is filled with hydraulic fluid under pressure.

When the apparatus 28 is first located within the casing 20 at the desired location for creation of a fan-shaped slot, hydraulic pressure is applied to the apparatus 28 thus causing the telescoping member 132 to extend the positioning wheel 130 thus pushing the jet nozzle 128 up against the inside of the casing 20. Hydraulic fluid exiting the jet nozzle 128 will soon form the opening such as 36A in the casing 20. The tip of the jet nozzle 128 will enter the opening 36A. Then, the apparatus 28 may be pivoted back and forth through a slow sweeping motion of approximately 40° total movement. Using the opening 36A as the pivot point for the tip of the jet nozzle 128, this back-and-forth sweeping motion will form the fan-shaped slot 34A. It will be seen that apparatus 28 is used to cut fan-shaped slots 34 one at a time.

EMBODIMENT OF FIG. 7

Figure 7:
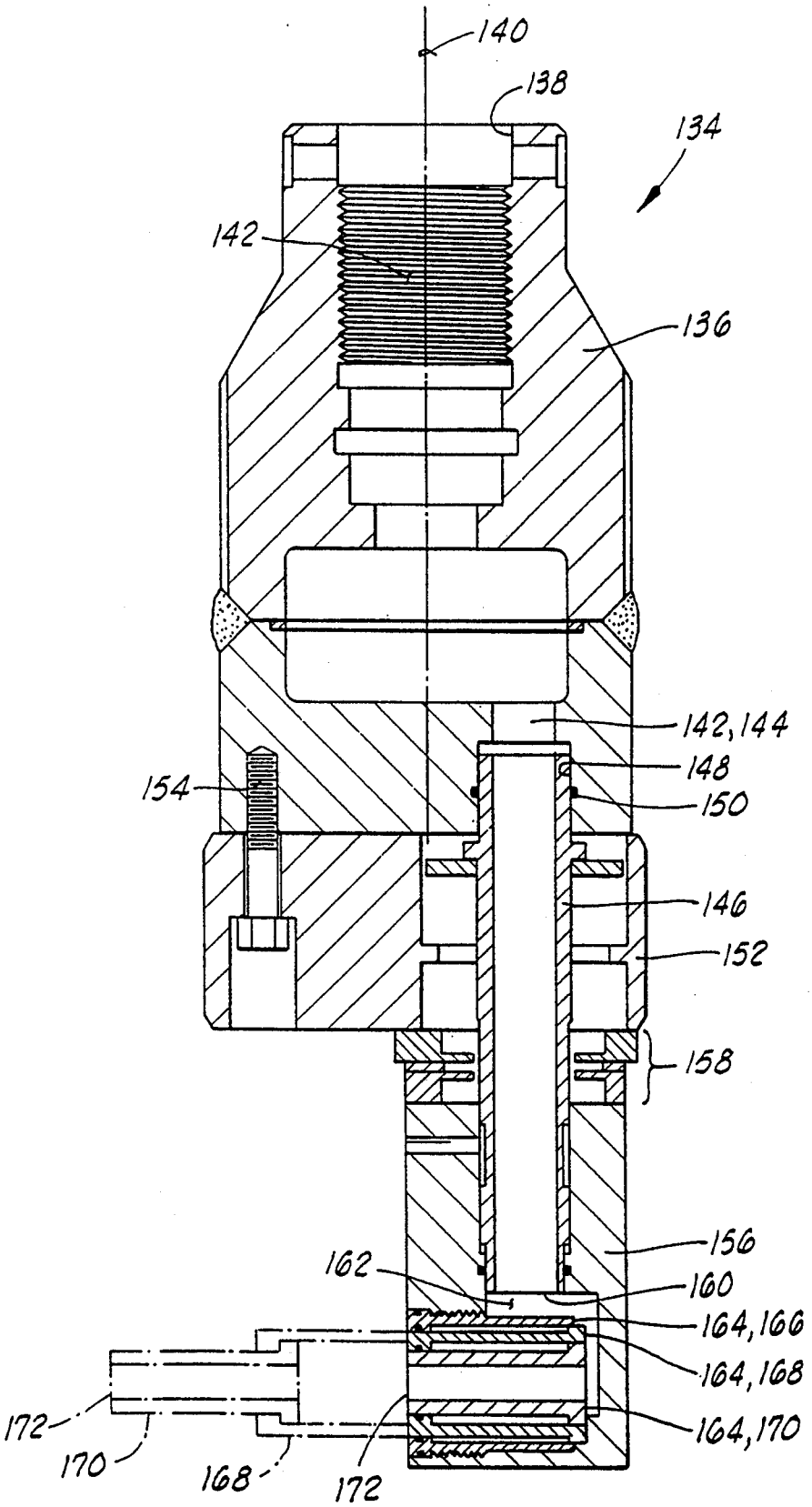
FIG. 7 is a sectioned elevation view of an alternative hydraulic well jetting apparatus for cutting the fan-shaped slots one at a time.

FIG. 7 illustrates an alternative embodiment of a hydraulic jetting tool for cutting the fan-shaped slots one at a time. The hydraulic jetting tool of FIG. 7 is generally designated by the numeral 134. The apparatus 134 includes a housing 136 having an upper end with an upper end opening 138 adapted to be connected to a conventional tubing string such as 30 (see FIG. 1) on which the apparatus 134 is lowered into the well. The tubing string 30 will preferably carry a centralizer (not shown) located a short distance above the upper end of the apparatus 134 so that the apparatus 134 will have its longitudinal axis 140 located generally centrally within the casing 20.

The housing 136 has an irregular passage 142 defined therethrough. The irregular passage 142 includes an eccentrically offset lower portion 144. A hollow shaft 146 has its upper end portion received within a bore 148 of eccentric passage portion 144 with an O-ring seal 150 being provided therebetween. An end cap 152 is attached to housing 136 by bolts such as 154 to hold the hollow shaft 146 in place relative to housing 136.

A nozzle holder 156 is concentrically received about the lower end portion of hollow shaft 146 and is rotatably mounted relative to end cap 152 by a swivel schematically illustrated and generally designated by the numeral 158. The hollow shaft 146 has an open lower end 160 communicated with a cavity 162 defined in the nozzle holder 156.

A laterally extendable telescoping nozzle 164 is also received in cavity 162. Telescoping nozzle 164 includes an outer portion 166, an intermediate portion 168, and an innermost portion 170.

When hydraulic fluid under pressure is provided to the cavity 162, the differential pressures acting on the innermost portion 170 and intermediate portion 168 of telescoping nozzle 164 will cause the innermost portion 170 to move to the left relative to intermediate portion 168, and will cause the intermediate portion 168 to extend to the left relative to outer portion 164, so that an open outer end 172 of the telescoping nozzle 164 will extend to the position shown in phantom lines in FIG. 7.

Thus, to use the apparatus 134 of FIG. 7, the apparatus is lowered into the well on the tubing string 30 until it is adjacent the location where it is desired to cut the fan-shaped slots. Then hydraulic fluid under pressure is provided through tubing string 30 to the apparatus 134 to cause the telescoping nozzle 164 to extend outward to the position shown in phantom lines in FIG. 7 wherein the open outer end 172 will be adjacent the inner wall of the casing 20. The hydraulic fluid exiting the open end 172 will soon create an opening 36 in the wall of casing 20 through which the outer end 172 of the inner nozzle portion 170 will extend. Then, the apparatus 134 is continuously rotated about its longitudinal axis 140 by rotating tubing string 30. The eccentric location of nozzle holder 156 will thus cause the nozzle 164 to pivot back and forth through an angle about the opening 36 which forms the pivot point for the outer end 172 of the telescoping nozzle 164. As the apparatus 134 rotates, the nozzle 164 will partially collapse and then extend so that open end 172 stays in opening 36.

After a first fan-shaped slot such as 34A has been formed, hydraulic pressure is released while the apparatus 134 is rotated through an angle of approximately 90°. Then hydraulic pressure is again applied and the telescoping nozzle 174 will again be pressed against the inner wall of casing 20 and the process is repeated to form another fan-shaped slot such as 34B.

EMBODIMENT OF FIGS. 8A–8D

A potential problem with the first-described apparatus 28 embodiment of FIG. 2 or the alternate embodiment of hydraulic jetting tool 134 of FIG. 7 is that, since these devices are used to cut a single slot and then rotated to form another slot, there is a possibility of longitudinal misalignment of the various slots. If the misalignment of the slots is too great and the slots are too far from being coplanar, then the fracture initiation may not occur as desired. Also, even if the alignment of the slots is adequate, apparatus 28 and 134 require that the tool string be rotated from the surface to position and operate the tool. Not only does this take time, but the rotation itself can be a major problem, especially if the tool is used with a coiled tubing unit.

Referring now to FIGS. 8A–8D and 9–12, a preferred embodiment of the hydraulic jetting apparatus of the present invention which eliminates these problems is shown and generally designated by the numeral 200. Apparatus 200 is used to cut a plurality of slots substantially simultaneously, thereby insuring that the slots are coplanar, and this is accomplished without any rotation of the tool string. Also, the time required to cut the slots is reduced.

Jetting apparatus 200 generally comprises a motor section 202, a speed reducer section 204 and a jetting section 206. Motor section 202 is used to provide torque for operating jetting section 206. Speed reducer section 204 reduces the rotational speed between motor section 202 and jetting section 206.

Motor section 202 is of a kind known in the art such as manufactured by Roper Pumps and generally comprises a progressive cavity motor having a stator assembly 208 with a rotor 210 rotatably disposed in the stator assembly.

Stator assembly 208 includes a stator case 212. Stator case 212 has a threaded outer surface 214 at its upper end which is adapted for connection to a coiled tubing unit or other tool string. A longitudinal bore 216 is defined through stator case 212, and a stator 218 is disposed in bore 216 and preferably in sealing contact therewith. Stator 218 is made of an elastomeric material.

Rotor 210 extends through stator 218 and is substantially coaxial with the stator and stator case 212.

Stator 218 and rotor 210 define an axially extending motor chamber 220, which may also be referred to as a driving chamber 220, therein. Motor chamber 220 is in communication at its upper end with an inlet chamber 222 in stator case 212 and a generally annular outlet chamber 224 at the lower end of the stator case. The inner surface of the stator 218 defining motor chamber 220 preferably is corrugated such that a helical screw-like thread 226 are defined therealong.

The outer surface of rotor 210 defines a rounded, substantially helical screw-type threaded surface 228 thereon. The interaction of threaded rotor surface 228 with threaded stator surface 226 in motor chamber 220 forms a plurality of cavities 230 spaced along the length of the pumping chamber.

Rotor 210 is shown with an optional central opening 232 therethrough which extends longitudinally downwardly from rounded upper end 234 of the rotor. The opening 232 is added to the prior art pump in order to reduce its speed somewhat.

The lower end of stator case 212 is attached to adapter sub 236 at threaded connection 238. A sealing means, such as O-ring 240 shown in FIG. 8C, provides sealing engagement between stator case 212 and adapter sub 236. A locking means, such as a plurality of set screws 242, may be used for locking adapter sub 236 to stator case 212.

The lower end of rotor 210 defines an enlarged longitudinally extending opening 244 which is in communication with central opening 232. A plurality of rotor ports 246 insure communication between opening 244 and outlet chamber 224.

Rotor 210 is attached at its lower end to an adapter 248 at threaded connection 250. Adapter 248 has a downwardly extending adapter shaft 249 thereon.

The lower end of adapter sub 236 is attached to a speed reducer body 252 at threaded connection 254. A sealing means, such as O-ring 256, provides sealing engagement between adapter sub 236 and speed reducer body 252, and a locking means may be used for locking the speed reducer body to the adapter sub. In the embodiment shown, the locking means is characterized by a plurality of set screws 258 which are threadingly engaged with speed reducer body 252 and extend into a corresponding plurality of holes 260 defined in adapter sub 236.

Speed reducer body 252 defines successively smaller first, second and third bores 262, 264 and 266. O-ring 256 seals on first bore 262. An upwardly facing annular shoulder 268 is defined between second bore 264 and third bore 266. A longitudinally extending keyway 270 is formed in third bore 266.

A gear box 272 is disposed in speed reducer body 252 such that a first outside diameter thereof fits within second bore 264 of speed reducer body 252 and a second outside diameter 276 fits within third bore 266. A downwardly facing annular shoulder 278 is defined between first outside diameter 274 and second outside diameter 276 and is adapted for engagement with shoulder 268 in speed reducer body 252.

A longitudinally extending keyway 280 is formed in second outside diameter 276 of gear box 272 and is substantially aligned with keyway 270 in speed reducer body 252. A key 282 is disposed in the aligned keyways 270 and 280, thus providing means for preventing relative rotation between gear box 272 and speed reducer body 252.

Figure 9:
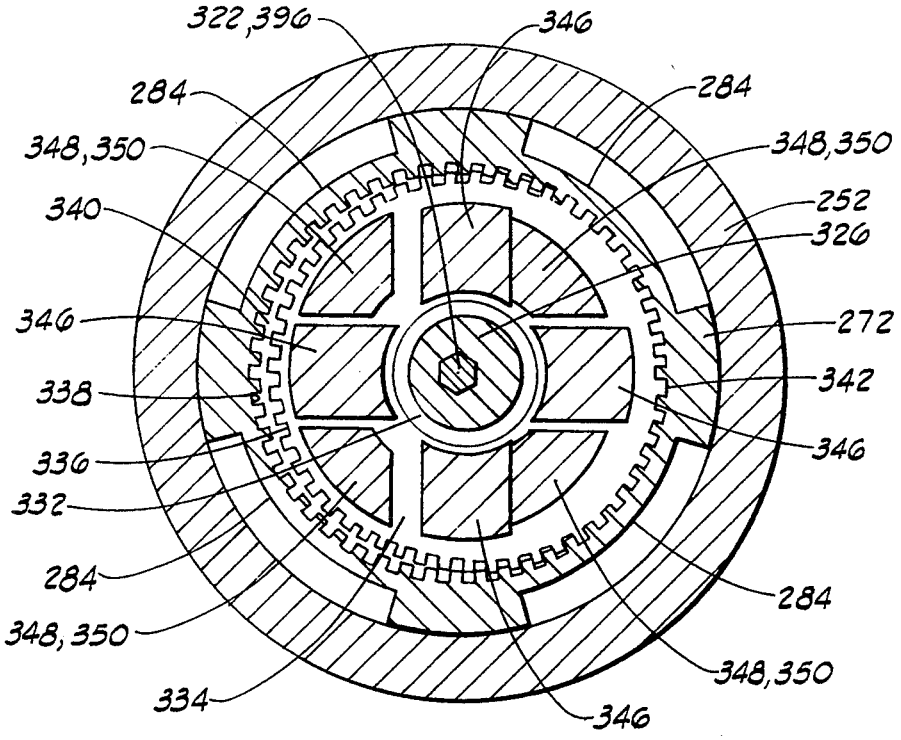

Referring now to FIGS. 8C and 9, gear box 272 has a plurality of outwardly facing arcuate recesses 284 defined in the outer portion thereof. Recesses 284 extend longitudinally and thus provide communication between outlet chamber 224 of motor section 202 and a lower chamber 286 below gear box 272.

A speed reducer cover 288 is slidably disposed within a bore 290 defined in gear box 272. A sealing means, such as O-ring 292, provides sealing engagement between speed reducer cover 288 and third bore 266 of gear box 272. Speed reducer cover 288 defines a central opening therethrough.

A transmission input shaft 296 is rotatably supported within central opening 294 of speed reducer cover 288 by a pair of bearings 298 and 300. Bearings 298 and 300 are preferably identical, tapered roller bearings positioned in opposite directions on opposite sides of a shoulder 301. However, the invention is not intended to be limited to any particular bearing configuration.

The upper end of transmission input shaft 296 is connected to adapter shaft 249 by a connecting slip or coupling 302 in a manner known in the art so that torque from adapter shaft 249 is transmitted to transmission input shaft 296. This can be accomplished by such means as a keyed opening in connecting slip 302 engaged by a flat portion on adapter shaft 249 and transmission input shaft 296 (not shown).

A gear box seal cap 304 is disposed in central opening 294 of speed reducer cover 288 and attached thereto at threaded connection 306. A sealing means, such as O-ring 307, provides sealing between gear box seal cap 304 and speed reducer cover 288.

Transmission input shaft 296 extends through gear box seal cap 304, and sealing engagement is provided therebetween by a cup seal 308. Cup seal 308 is held in place by a retainer ring 310.

It will be seen that gear box seal cap 304 is also used to clamp bearing 398 against shoulder 301.

Below bearing 300, a flat washer 312 and a lock washer 314 are disposed around transmission input shaft 296. A slotted nut 316 is engaged with transmission input shaft 296 at threaded connection 318 and is used to clamp lock washer 314 and flat washer 312 against bearing 300 and thus clamp bearing 300 against shoulder 301. A pin 320 extends through nut 316 and a corresponding portion of transmission input shaft 296 to prevent unthreading of the nut.

Referring now also to FIG. 9, a lower end 322 of transmission input shaft 296 has a hexagonal cross section and extends into a corresponding hexagonal opening 324 defined in a driver cam 326. A fastening means, such as screw 328, is used to attach driver cam 326 to lower end 322 of transmission input shaft 296.

Driver cam 326 has an outer surface 330 which is eccentric with respect to the axis of hexagonal opening 324 and thus eccentric with the axis of transmission input shaft 296 and adapter shaft 249. Outer surface 330 is preferably cylindrical.

Outer surface 330 of driver cam 326 is rotatably disposed in close relationship within a follower bushing 332. Follower bushing 332 in turn is positioned in a follower gear 334. Follower gear 334 has an outer geared surface 336. Outer geared surface 336 of follower gear 334 is coaxial with follower bushing 332 and thus with outer surface 330 of driver cam 336. It will therefore be seen by those skilled in the art that follower gear 334 is eccentrically disposed within gear box 272.

Gear box 272 has an internal geared surface 338. Geared surface 336 of follower gear 334 is partially engaged with geared surface 338 in gear box 272. As seen in FIG. 9, this geared engagement is shown to the right. That is, a gap 340 extends between geared surfaces 336 and 338 toward the left of follower gear 334. By rotation of transmission input shaft 296, and the corresponding rotation of driver cam 326, it will be seen that a center point of engagement 342 between geared surfaces 336 and 338 will be correspondingly rotated around geared surface 338. It will be seen from a study of FIG. 9 that as transmission input shaft 296 and driver cam 326 are rotated clockwise with respect to FIG. 9, that the central axis of follower gear 334 will also be moved clockwise about the axis of transmission input shaft 296, as will center point of engagement 342. This results in a counterclockwise rotation of follower gear 334 out its axis.

The assembly of these components will therefore act as a speed reducer. That is, the rotation of follower gear 334 about its axis will have a speed considerably less than the speed of rotation of transmission input shaft 296. In one embodiment, for example, a rotational speed of 1220 rpm for transmission input shaft 296 may result in a rotational speed of approximately 5 rpm for follower gear 334. The invention is not intended to be limited to this particular speed reduction, and the speed reduction may be varied as desired.

A retainer ring 344 is disposed in gear box 272 above follower gear 334 and prevents undesired upward movement thereof.

Extending downwardly on follower gear 334 are a plurality of gear lugs 346 which are angularly spaced from one another. In the illustrated embodiment, there are four gear lugs 346 spaced at 90°. However, the invention is not intended to be limited to any particular number of gear lugs.

Gear lugs 346 are positioned between corresponding yoke lugs 348 which extend upwardly on a follower yoke 350. Follower yoke 350 has a downwardly extending yoke shaft portion 352 which is rotatably supported in a lower end of gear box 272 by a bearing 354. Yoke shaft 352 is coaxial with transmission input shaft 296 and gear box 272, and thus follower gear 334 is eccentrically disposed with respect to the yoke shaft. It will be seen by those skilled in the art that as follower gear 334 is rotated as previously described, sequential contact of gear lugs 346 with yoke lugs 348 transfers the rotational motion from follower gear 334 to follower yoke 350. Of course, the resulting rotation of yoke shaft 352 is reduced from the original rotational speed of transmission input shaft 296.

Below bearing 354, a cup seal 356 providers sealing between yoke shaft 352 and gear box 272 as the yoke shaft rotates. It will be seen from a study of FIG. 8C that speed reducer section 204 defines a speed reducer chamber 358 therein in which driver cam 326 and follower gear 334 are disposed. Speed reducer chamber 358 is sealed at its upper end by O-rings 292 and 307 and cup seal 308. Chamber 358 is sealed at its lower end by cup seal 356. Speed reducer chamber 358 is preferably filled with a lubricant, such as oil, to provide lubrication for movement and interaction of the various components in speed reducer section 204, including bearings 298 and 300, driver cam 326, follower gear 334, follower yoke 350 and bearing 354. This lubricant in speed reducer chamber 358 is thus sealingly separated from the sand-laden jetting fluid which flows downwardly through apparatus 200. That is, as the sand-laden fluid flows from motor section 202 through recesses 284 on gear box 272 into lower chamber 286, this sand-laden fluid cannot contaminate the moving components within speed reducer section 204.

The sand-laden fluid pumped through apparatus 200 is pumped at a high pressure, and if the construction of speed reducer section 204 were rigid, this would result in a high differential pressure between the sand-laden fluid outside speed reducer chamber 358 and the lubricating fluid within the speed reducer chamber. This high differential pressure would act against cup seals 308 and 356, resulting in reduced seal life and greater wear on transmission shafts 296 and yoke shaft 352 by the cup seals. Under such conditions, the sand particles would tend to lodge between the cup seals and the shaft surfaces, and the sealing surfaces would wear very rapidly due to the rotation of the shafts.

To avoid this differential pressure wear problem, speed reducer cover 288 is slidably positioned within bore 290 of gear box 272 such that the speed reducer cover acts as a floating piston within the gear box. When the high differential pressure is applied to speed reducer cover 288, it is free to move slightly such that the pressure within speed reducer chamber 358 is equalized with the fluid pressure outside speed reducer section 204. This equalized pressure reduces the wear on the seals and shafts, thereby greatly increasing wear life.

Referring now to FIGS. 8C and 8D, the lower end of speed reducer body 252 is attached to jetting gear housing 360 at threaded connection 362, and a sealing means, such as O-ring 364, provides sealing engagement therebetween. A plurality of set screws 366 are threadingly engaged with jetting gear housing 360 and extend into corresponding holes 368 in speed reducer body 252 to act as a locking means for locking the speed reducer body to the jetting gear housing.

A gear box cover 370 is slidably disposed in a bore 372 of jetting gear housing 360. A sealing means, such as O-ring 374, provides sealing engagement between gear box cover 370 and jetting gear housing 360.

Gear box cover 370 defines a central bore 376 therethrough with a radially inwardly extending shoulder 378 near a lower end of the bore.

A cam shaft 380 extends through central bore 372 in gear box cover 370. Cam shaft 380 has an upwardly facing annular shoulder 382 thereon which faces the lower side of shoulder 378 in gear box cover 370. A plurality of bearing balls 384 are disposed between shoulders 382 and 378.

A washer 386 is disposed above shoulder 378 in gear box cover 370. A plurality of bearing balls 388 are disposed between washer 386 and shoulder 378.

A radially inwardly extending tang 390 on washer 386 extends into a longitudinally disposed slot 392 in cam shaft 380. It will be seen that washer 386 thus rotates with cam shaft 380. See FIG. 10.

A nut 394 is attached to cam shaft 380 at threaded connection 396. When nut 394 is tightened on cam shaft 380, it will be seen that shoulder 382 on cam shaft 380 is clamped toward shoulder 378 in gear box cover 370 to hold balls 384 in place. Similarly, washer 386 is clamped toward shoulder 378 to hold balls 388 in place. Nut 394 is tightened such that balls 384 and 388 will roll as the cam shaft is rotated. Thus, it may be said that balls 384 and 388 act as a bearing means for rotatably supporting cam shaft 380 in gear box cover 370. Other types of bearing means, such as self contained bearings could also be used.

Above nut 394, a seal collar 398 is connected to gear box cover 370 at threaded connection 400. A sealing means, such as O-ring 402, provides sealing engagement between seal collar 398 and gear box cover 370. An upper end of cam shaft 380 extends upwardly through seal collar 398, and a cup seal 404 provides sealing between the seal collar and cam shaft, as the cam shaft rotates. A retainer ring 405 prevents undesired upward movement of cup seal 404.

Referring again to FIGS. 8C and 8D, the upper end of cam shaft 380 is connected to yoke shaft 352 of follower yoke 350 by a connecting slip or coupling 406.

Connecting slip 406 connects yoke shaft 352 and cam shaft 380 such that torque is transferred to the cam shaft. The shafts may have flats thereon which extend into a D-shaped hole (not shown) through the connecting slip. However, any other means of coupling shafts may also be used.

Still referring to FIGS. 8D and 10, gear box cover 370 defines a plurality of angularly spaced, longitudinally extending holes 408 therethrough. In the illustrated embodiment, there are four such holes 408 identified as 408A, 408B, 408C and 408D. Extending through each hole 408 is a jetting tube 410. The jetting tubes 410 are identified in the drawings as 410A, 410B, 410C and 410D, respectively. Each jetting tube 110 defines a longitudinally extending port 412 therethrough.

Each jetting tube 410 is rotatably supported within the corresponding hole 408 in gear box cover 370 by a bushing 414. Above each bushing 414 is a cup seal 416 which provides sealing between each tube 410 and gear box cover 370 as jetting tubes 410 pivot, as will be further described herein. A retainer ring 418 prevents undesired upward movement of each cup seal 416.

Jetting gear housing 360 has a lower gear housing portion or wall 420 which is spaced below gear box cover 370 such that a gear chamber 422 is defined therebetween.

Each of jetting tubes 410 is rotatably supported in lower gear housing portion 420 by a bearing 424. A cup seal 426 provides sealing engagement between each jetting tube 410 and lower gear housing portion 420 below each corresponding bearing 424.

Referring now to FIG. 11, each of jetting tubes 410A, 410B, 410C and 410D has a respective geared surface 428A, 428B, 428C and 428D thereon. These geared surfaces may also be referred to as pinion gears 428A, 428B, 428C and 428D. The pinion gears are all located within gear chamber 422.

A rack 430 is also disposed in gear chamber 422 and has geared surfaces 432A, 432B, 432C and 432D defined thereon. Geared surfaces 432A, 432B, 432C and 432D are adapted for engagement with pinion gears 428A, 428B, 428C and 428D, respectively. Rack 432 is positioned such that it may laterally reciprocate between pinion gears 410A and 410B and between pinion gears 410C and 410D. That is, when seen in FIG. 11, which is a downward view of rack 430, the rack may reciprocate from the lower right adjacent to a point 434 defined in jetting gear housing 360 to the upper left adjacent to a point 436 defined within the jetting gear housing. It will be seen by those skilled in the art that points 434 and 436 are approximately 180° apart on the inside of jetting gear housing 360.

Rack 430 has an elongated slot 438 formed therethrough. A lower cam shaft portion 440 of cam shaft 380 has a rack cam 442 extending eccentrically therefrom and into slot 438 of rack 430. Those skilled in the art will see that, as cam shaft 380 is rotated, rack cam 442 will be moved in slot 438 such that rack 430 is reciprocated between points 434 and 436 in jetting gear housing 360.

The reciprocating motion of rack 430 will cause alternating pivotation of pinion gears 428 and thus corresponding movement of jetting tubes 410. That is, as rack 430 is moved from the illustrated position in FIG. 11 adjacent to point 434 toward point 436, pinion gears 428A and 428D will be rotated clockwise, and pinion gears 428B and 428C will be rotated counterclockwise. As rack 430 is moved in the opposite direction, pinion gears 428A and 428D will be rotated counterclockwise, and pinion gears 428B and 428C will be rotated clockwise. In the preferred embodiment, the total angular movement of pinion gears 428, and thus jetting tubes 410, is approximately 100°.

Referring again to FIG. 8D, it will be seen that gear chamber 422 is sealed at its upper end by O-rings 374 and 402 and by cup seals 404 and 416. Gear chamber 422 is sealed at its lower end by cup seals 426. Gear chamber 422 is preferably filled with a lubricant, such as oil, to provide lubrication for the movement and interaction of the various components in gear chamber 422, including pinion gears 428, rack 430, bushings 414 and bearings 424. This lubricant in gear chamber 422 is thus sealingly separated from the sand-laden jetting fluid which flows downwardly through apparatus 200. That is, as the sand-laden fluid flows from speed reducer section 204 through ports 412 in jetting tubes 410, this sand-laden fluid cannot contaminate the moving components within gear chamber 422.

As previously discussed, the sand-laden fluid through apparatus 200 is pumped at a high pressure, and if the construction of jetting section 206 were rigid, this would result in a high differential pressure between the sand-laden fluid outside gear chamber 422 and the lubricating fluid within the gear chamber. This high differential pressure would act against cup seals 404, 416 and 426, resulting in reduced seal life and greater wear on jetting tubes 410 by the cup seals. Under such conditions, the sand particles would tend to lodge between the cup seals and the jetting tube surfaces, and the sealing surfaces would wear very rapidly due to the rotation of the jetting tubes.

As with the pressure balancing system of speed reducer section 204, gear box cover 370 is slidably positioned within bore 372 of jetting gear housing 360 such that the gear box cover acts as a floating piston within the jetting gear housing. When the high differential pressure is applied to gear box cover 370, it is free to move slightly such that the pressure within gear chamber 422 is equalized with the fluid pressure of the sand-laden fluid in jetting section 206. This equalized pressure reduces the wear on the seals and shafts, thereby greatly increasing wear life.

A jetting section guide nose 444 is attached to the lower end of jetting gear housing 360 by any means known in the art. Referring now to FIGS. 8D and 12, guide nose 444 defines a guide nose chamber 446 therein. A plurality of jetting ports 448 provide communication between guide nose chamber 446 and the wellbore. In the illustrated embodiment, there are four such jetting ports 448 identified as jetting ports 448A, 448B, 448C and 448D.

The lower end of each of jetting tubes 410A, 410B, 410C and 410D extends downwardly below lower gear housing portion 420 and into a bore 450 defined in each of a plurality of jet heads 452, identified respectively as jet head 452A, 452B, 452C and 452D. Each of jet heads 452A, 452B, 452C and 452D is attached to the corresponding jetting tube 410A, 410B, 410C and 410D at threaded connection 454. A locking means, such as a set screw 456 is used to prevent relative rotation between jetting tubes 410 and jet heads 452. A sealing means, such as a plurality of O-rings 458, provides sealing engagement between each jetting tube 410 and the corresponding jet head 452.

Each bore 450 in jet head 452 is in communication with an angularly disposed hole 460 which is closed at its lower end by a plug 462. Each of jet heads 452 has a nozzle body 464 attached thereto at threaded connection 466. The nozzle bodies 464 are identified respectively as nozzle bodies 464A, 464B, 464C and 464D. A nozzle insert 468 is disposed in each of nozzle bodies 464. Each of nozzle bodies 464A, 464B, 464C and 464D is substantially aligned with a corresponding jetting port 448A, 448B, 448C and 448D in guide nose 444.

OPERATION OF THE WELL JETTING APPARATUS EMBODIMENT OF FIGS. 8A–8D

To use well jetting apparatus 200, the apparatus is lowered into the well on tubing string 30 until it is adjacent the location where it is desired to cut the fan-shaped slots. Hydraulic fluid under pressure is then provided through tubing string 30 to apparatus 200. Some of the fluid will flow directly through central opening 232 of rotor 210, if present, in motor section 202, but another portion of the fluid, or all of the fluid if opening 232 is not present, will be forced to flow through motor chamber 220 causing rotation of the rotor within stator 218, resulting in rotation of adapter shaft 249 at the lower end of motor section 202. Under normal conditions in the preferred embodiment, the speed of adapter shaft 249 will be approximately 120 rpm as already noted.

As previously described, torque is transferred to transmission input shaft 296, and the speed is reduced through speed reducer section 204. In the preferred embodiment, the rotation of driver cam 326 at approximately 120 rpm results in an output speed of yoke shaft 352 of approximately 5 rpm as a result of the interaction of the driver cam with follower gear 334 and of the follower gear with geared surface 338 in gear box 272.

The torque from yoke shaft 352 is transferred to cam shaft 380, as previously described, and thus to rack cam 442. One revolution of cam shaft 380 thus results in one complete reciprocating cycle of rack 430. This cycle of rack 430 results in pivotation back and forth through approximately 100° of each pinion gear 428. Those skilled in the art will thus see that the corresponding pivotation of each jetting tube 410A, 410B, 410C and 410D results in pivotation of nozzle bodies 464A, 464B, 464C and 462. Thus, a fan-shaped pattern of fluid is jetted through jetting ports 448A, 448B, 448C and 448D to form the pattern of fan-shaped slots 34A, 34B, 34C and 34D shown in FIG. 2. However, with jetting apparatus 200, each of fan-shaped slots 34 is cut substantially simultaneously, rather than one at a time as with the previous embodiments.

THE EMBODIMENT OF FIG. 13

FIG. 13 is a view similar to FIG. 1 showing the use of certain aspects of the present invention in connection with a well wherein the horizontal portion of the well includes portions of slotted casing separated by portions of solid casing incorporating slip joints and utilizing the radial slotting techniques of the present invention.

In FIG. 13, the horizontal portion of the well includes first, second and third segments of slotted casing designated as 172, 174 and 176, respectively. Those segments of slotted casing are surrounding by open portions of the borehole 12 so that the borehole 12 freely communicates with the interior of the slotted casing through slots such as generally designated as 178. The borehole surrounding the slotted casing segments may be gravel packed.

Located between the segments of slotted casing are first and second segments of solid casing 180 and 182. Each segment of solid casing includes slip joints 55 and 57 such as previously described with regard to FIG. 6.

The wellbore adjacent each of the segments 180 and 182 of solid casing is spot-cemented as indicated at 184 and 186, respectively. The segments of solid casing are then communicated with the zones 24 and 26, respectively, through the use of the radial slotting techniques previously described wherein slots 34 and openings 36 are formed through the solid casing at locations between the casing slip joints.

Then, a straddle packer (not shown) can be lowered on tubing string into the casing so as to fracture the zones of interest 24 and 26 individually through their fan-shaped slots 34. The casing slip joints 55 and 57 along with the fan-shaped slots 34 will cause the fractures to radiate outward into the zones 24 and 26 while the spot-cement 184 and 186 will still provide isolation between the zones 24 and 26.

Thus it is seen that the present invention readily achieves the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A method of modifying a well having a casing intersecting a subsurface formation, said method comprising the steps of:

inserting a hydraulic jetting tool into said casing;

forming a plurality of openings through said casing; and with said hydraulic jetting tool, directing a plurality of hydraulic jets therefrom, each of said hydraulic jets being directed through a corresponding one of said openings, and substantially simultaneously cutting a plurality of fan-shaped slots in said subsurface formation in a plane substantially transverse to a longitudinal axis of said casing.

2. The method of claim 1 wherein the step of directing and cutting comprises cutting said plurality of fan-shaped slots such that each of said fan-shaped slots circumscribes a substantially larger arc about said axis than does the opening through which said slot is cut.

3. The method of claim 1 wherein the step of directing and cutting comprises cutting said plurality of fan-shaped slots such that said plane is substantially perpendicular to said longitudinal axis of said casing.

4. The method of claim 1 wherein the step of directing and cutting comprises directing said plurality of hydraulic jets and cutting said plurality of fan-shaped slots without rotation of the jetting tool.

5. The method of claim 1 wherein the step of forming a plurality of openings comprises directing said plurality of hydraulic jets toward said casing for cutting said openings in said casing.

6. The method of claim 1 wherein the step of directing and cutting comprises cutting said fan-shaped slots such that each of said fan-shaped slots describes an angle of at least approximately 100°.

7. The method of claim 1 further comprising:

applying a high pressure fracturing fluid to said plurality of fan-shaped slots; and initiating a fracture in said subsurface formation and a plane defined by said plurality of fan-shaped slots.

8. The method of claim 1 wherein the step of cutting said plurality of fan-shaped slots comprises creating a localized least principal stress direction in said subsurface formation substantially parallel to said longitudinal axis of said casing, thereby aiding subsequent fracture initiation in a plane generally perpendicular to said longitudinal axis.

9. The method of claim 1 further comprising maintaining a structural integrity of said casing.

10. A method of modifying a well comprising the steps of:

inserting a hydraulic jetting tool into a well casing which is deviated greater than about 45° from a vertical direction;

forming a plurality of openings through said casing; and directing a plurality of hydraulic jets from said hydraulic jetting tool through corresponding openings through said casing and substantially simultaneously cutting a plurality of fan-shaped slots in said subsurface formation in a plane substantially transverse to said longitudinal axis.

* * * * *